US009482406B2

(12) United States Patent
Merrow et al.

(10) Patent No.: US 9,482,406 B2
(45) Date of Patent: Nov. 1, 2016

(54) MULTILAYERED LIGHTING DEVICE

(71) Applicant: Merrow Sewing Machine Co., Fall River, MA (US)

(72) Inventors: Owen W. Merrow, Cranston, RI (US); Charles G. Merrow, Westport, MA (US)

(73) Assignee: MERROW SEWING MACHINE CO., Fall River, MA (US)

( * ) Notice: Subject to any disclaimer, the term of this patent is extended or adjusted under 35 U.S.C. 154(b) by 96 days.

(21) Appl. No.: 14/338,849

(22) Filed: Jul. 23, 2014

(65) Prior Publication Data

US 2016/0025295 A1 Jan. 28, 2016

(51) Int. Cl.
*F21L 4/00* (2006.01)
*F21V 25/00* (2006.01)
(Continued)

(52) U.S. Cl.
CPC .. *F21V 5/02* (2013.01); *F21L 4/00* (2013.01); *F21V 15/01* (2013.01); *F21V 23/0414* (2013.01); *F21V 31/005* (2013.01); *F21V 7/22* (2013.01); *F21V 33/0076* (2013.01); *F21W 2111/10* (2013.01); *F21Y 2101/00* (2013.01);
(Continued)

(58) Field of Classification Search
CPC ..... F21L 4/00; F21L 4/005; F21L 4/027; F21L 4/04; F21V 5/02; F21V 7/22; F21V 23/003; F21V 23/0414; F21V 31/005; F21V 33/0004; F21V 33/0008; F21W 2111/10; F21W 2121/06; A41D 13/01; A41D 19/0157; A41D 27/085; F21K 9/30; F21K 9/90; F21S 4/003; F21S 4/005; F21S 4/006
See application file for complete search history.

(56) References Cited

U.S. PATENT DOCUMENTS 5,575,554 A * 11/1996 Guritz ..... A41D 27/085 362/103
5,577,828 A 11/1996 Nadel et al.
(Continued)

FOREIGN PATENT DOCUMENTS

CN 201373281 12/2009
DE 20 2004 013832 11/2004
(Continued)

OTHER PUBLICATIONS

U.S. Appl. No. 29/497,324, Merrow et al., filed Jul. 23, 2014.
(Continued)

*Primary Examiner* — Peggy Neils
*Assistant Examiner* — Alexander Garlen
(74) *Attorney, Agent, or Firm* — Smith, Gambrell & Russell, LLP

(57) ABSTRACT

A light device and a method of making the same. The light device having a casing, or body, in the form of a multilayered stack that includes a supporting base layer, a scattering layer above the base layer, and an outermost protective layer above the scattering layer. The light device further includes a lighting unit contained within the casing, for emitting light outside the light device. The multilayered stack of the casing may further include a spacer arrangement, either as a separate layer between the base layer and the scattering layer, or as an integrated arrangement of one or both of the base layer and the scattering layer. The outermost protective layer may also be a prism layer having a one-way light transmitting character, and a one-way light reflecting character. The bottom layer may include a fastening element for releasably fastening the light device to a separate mounting unit.

21 Claims, 6 Drawing Sheets

(51) Int. Cl.

| | |
|---|---|
| ***F21V 31/00*** | (2006.01) |
| ***F21V 5/02*** | (2006.01) |
| ***F21V 23/04*** | (2006.01) |
| ***F21V 15/01*** | (2006.01) |
| *F21V 33/00* | (2006.01) |
| *F21V 7/22* | (2006.01) |
| *F21W 111/10* | (2006.01) |
| *F21Y 101/00* | (2016.01) |

(52) U.S. Cl.
CPC ..... *F21Y 2113/13* (2016.08); *F21Y 2113/20* (2016.08); *F21Y 2115/10* (2016.08)

(56) References Cited

U.S. PATENT DOCUMENTS

| | | | | |
|---|---|---|---|---|
| 6,059,414 | A * | 5/2000 | Tsai | A41D 13/01 359/516 |
| 6,115,948 | A | 9/2000 | Mitchell | |
| 6,481,868 | B1 * | 11/2002 | Lin | F21L 4/00 362/158 |
| 6,994,445 | B1 | 2/2006 | Pomes | |
| 7,506,991 | B2 | 3/2009 | Esses | |
| 7,976,178 | B2 * | 7/2011 | Esses | A41B 11/001 362/103 |
| 8,044,570 | B2 | 10/2011 | Oyaizu et al. | |
| 8,083,392 | B2 | 12/2011 | Chien | |
| 8,525,402 | B2 | 9/2013 | Aeling et al. | |
| 2004/0076000 | A1 | 4/2004 | Thorp | |
| 2004/0264166 | A1 | 12/2004 | Chien | |
| 2006/0250695 | A1 * | 11/2006 | Welch | A41D 27/085 359/516 |
| 2010/0110727 | A1 | 5/2010 | Iwasaki | |
| 2010/0165634 | A1 | 7/2010 | Hong et al. | |
| 2012/0075869 | A1 | 3/2012 | Chang | |
| 2012/0318985 | A1 * | 12/2012 | Bushee | A01K 27/006 250/342 |
| 2013/0019372 | A1 | 1/2013 | Esses | |
| 2013/0120969 | A1 | 5/2013 | Rensmo | |
| 2013/0141905 | A1 | 6/2013 | Hussell et al. | |
| 2013/0181246 | A1 | 7/2013 | Wu | |
| 2013/0224436 | A1 | 8/2013 | Kim et al. | |

FOREIGN PATENT DOCUMENTS

| | | |
|---|---|---|
| WO | 2006/042225 | 4/2006 |
| WO | 2006/084455 | 8/2006 |
| WO | 2011/063213 | 5/2011 |

OTHER PUBLICATIONS

LED-lit Tron v2.0 suit advertisement retrieved from http://www.instructables.com/id/LED-lit-Tron-v20-suit/step10/Add-Velcro-to-the-shirt-and-the-LEDs/ on Oct. 11, 2013.

* cited by examiner

MULTILAYERED LIGHTING DEVICE

FIELD OF THE INVENTION

The present invention relates to a light device, and methods of assembling the same. In a particular aspect, the present invention is directed at a lightweight and portable light device capable of releasable fastening to a mounting base.

BACKGROUND OF THE INVENTION

Many popular outdoor activities present safety concerns, especially regarding visibility of the participant. For example, activities such as running and bicycling along urban roadways present a risk of injury from passing vehicles; and activities such as hiking, camping and boating in rural areas present difficulties in locating injured and stranded individuals. These concerns are elevated when the activities are undertaken in low-light environments, and during early morning and late evening periods of the day.

At present, there are lighting devices available for enhancing ones visibility. However, these traditional lighting devices are made of glass and/or hard plastics, with rigid and sometimes fragile casings of relatively considerable bulk (e.g., greater than 1" in thickness) and heft (e.g., greater than 20 grams). Also, traditional lighting devices are generally not constructed to withstand water, dust, and/or shock damage. As a result, these traditional lighting devices are inconvenient in that they add additional weight and are prone to damage.

In addition, traditional lighting devices are typically constructed as integrated components of another article, such as lights integrated within the shell of a safety helmet and lights built within the frame of a bicycle or boat. As a result, these traditional lighting devices are suitable only for use with the particular article in which they are fixed, and are not readily transferrable for use on other objects and surfaces.

As such, there remains a need in the art for a portable and lightweight light device, constructed of resilient and durable materials; and preferably constructed in a waterproof, dustproof, and/or shock resistant manner. There also remains a need for such a light device that is adapted for a tool-free transfer from one object or surface to another, thereby allowing the light device to serve multiple different uses.

SUMMARY OF THE INVENTION

The present invention is directed at a light device and a method of making the same. The light device having a casing, or body, in the form of a multilayered stack that includes a supporting base layer, a scattering layer above the base layer, and a prism layer above the scattering layer. The multilayer stack may further include a spacer arrangement, either as a separate layer between the base layer and the scattering layer, or as an integrated arrangement of one or both of the base layer and the scattering layer.

The light device further includes a lighting unit contained within the casing; the lighting unit including a power source, a light source, a switch, and a circuit electrically connecting the power source, light source, and switch. The lighting unit is contained within a hermetic enclosure making the light device waterproof and dustproof; and is also supported by at least one layer in the light device body that acts as a shock absorbing layer.

The scattering layer having a hole therethrough that is aligned along a common vertical axis with the light source, and a light diffusing character; and the prism layer having at a one-way light transmitting character that permits transmission of light emitted from the light source to an outside of the light device, and a one-way light reflecting character that reflect light originating outside the light device. The arrangement of the scattering layer with the hole and the prism layer being effective to yield a gradient light effect for light emitted from the light source; and the prism layer being effective to create a shimmering reflective effect for external light striking the prism layer.

The base layer of the casing, as a supporting bottommost layer of the light device, includes a releasable fastening element for joining with a mating fastening element on a mounting unit, such that the light device may be joined to another object or surface on which the fastening unit is joined.

The layers of the multilayered stack, forming the casing of the light device, are secured to one another by at least one securing mechanism, which may include stitching around the periphery of the light device.

As such, the present invention provides a durable and versatile light device with a low-profile that is portable and adapted for releasably joining with a separate mounting unit; and which is suitable as both a powered light-emitting device and an unpowered light reflecting device.

Both the foregoing general description and the following detailed description are exemplary and explanatory only and are intended to provide further explanation of the invention as claimed. The accompanying drawings are included to provide a further understanding of the invention; are incorporated in and constitute part of this specification; illustrate several embodiments of the invention; and, together with the description, serve to explain the principles of the invention.

BRIEF DESCRIPTION OF THE DRAWINGS

Further features and advantages of the invention can be ascertained from the following detailed description, which is provided in connection with the drawings described below.

DETAILED DESCRIPTION OF THE INVENTION

The present invention is directed at a light device 100, and a method of assembly for the same. The following disclosure discusses the present invention with reference to the examples shown in the accompanying drawings, though it is understood the invention is not limited to the examples discussed herein.

The Light Device

Figure 1:
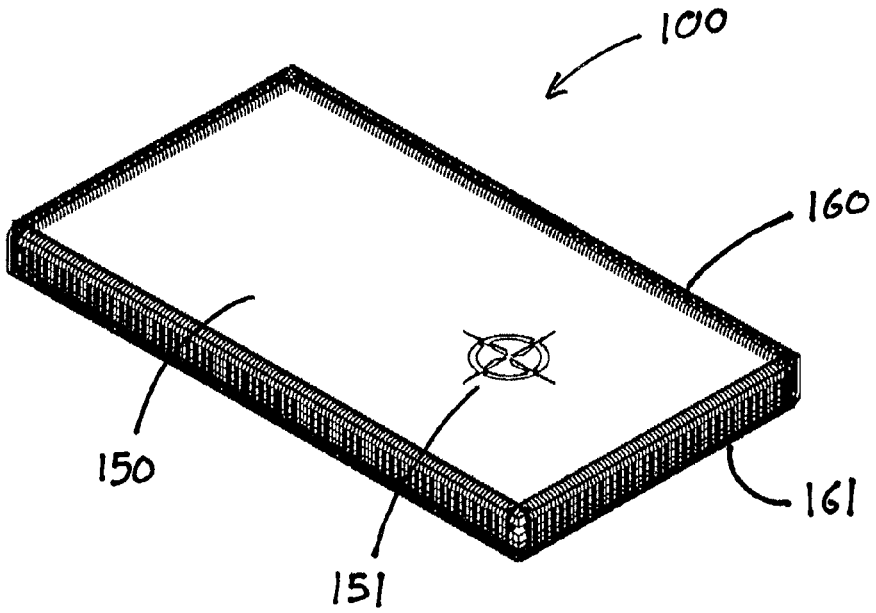
FIG. 1 shows a perspective view of a light device according to one example of the present invention.
Figure 2:
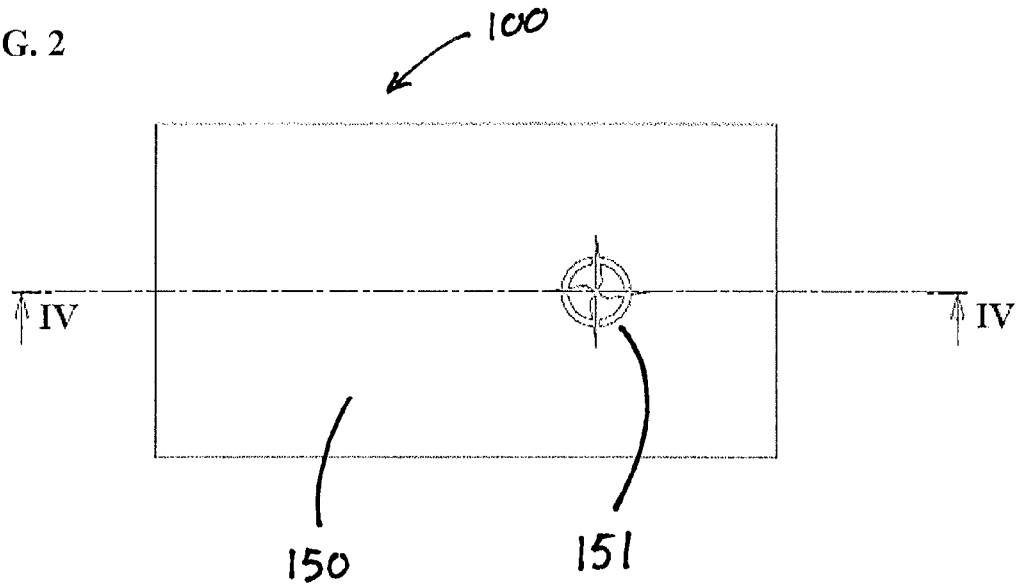
FIG. 2 shows a top plan-view of the light device in FIG. 1.

FIG. 1 shows an example of an assembled light device 100 according to the present invention. In the assembled state, as an outermost layer, there is seen a prism layer 150 having an actuation mark 151, and a securing mechanism 160 in the form of stitching 161. FIG. 2 shows a top plan-view of the assembled light device 100, though with the stitching 161 omitted from the view.

Figure 3:
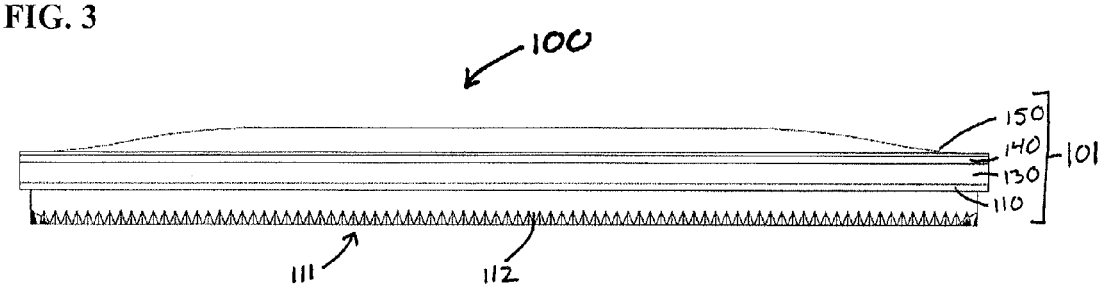
FIG. 3 shows a profile-view of the light device in FIG. 1.

FIG. 3 shows a profile view of the light device 100, again with the stitching 161 omitted from the view. In FIG. 3 it may be seen the light device 100 is formed of a multilayered stack 101 made of multiple separate layers, including: a base layer 110, a first intermediate spacer layer 130, a second intermediate scattering layer 140, and the top or outermost prism layer 150. The multilayered stack 101 may also be referred to as a casing or body of the light device 100. In the example of FIG. 3, the base layer 110 has a fastening element 111 in the form of a collection of hooks 112, as one-half of a hook-and-loop fastener (e.g., such as that sold under the brand name Velcro®).

Figure 4:
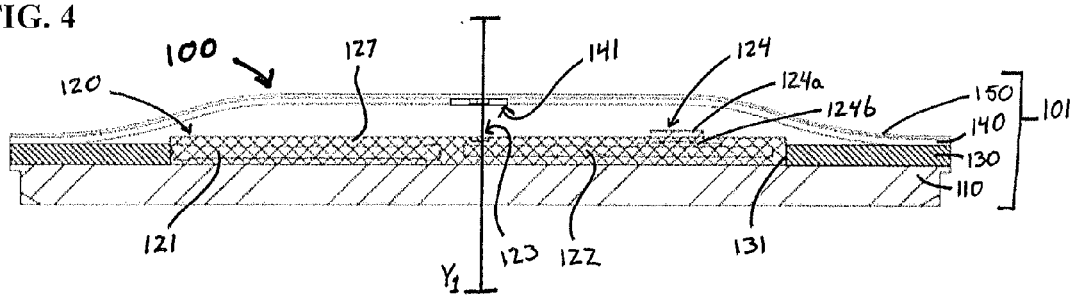
FIG. 4 shows a cross-section view of the light device, as seen along line Iv-Iv in FIG. 2.

FIG. 4 shows a cross-sectional view of the light device 100, as taken along line IV-IV in FIG. 2. The view in FIG. 4 is simplified by omission of the stitching 161 and the collection of hooks 112. FIG. 4 again shows the base layer 110, the spacer layer 130, the scattering layer 140, and the prism layer 150—though further shows a lighting unit 120 received within a recess 131 of the spacer layer 130; and a hole 141 in the scattering layer 140.

Figure 5:
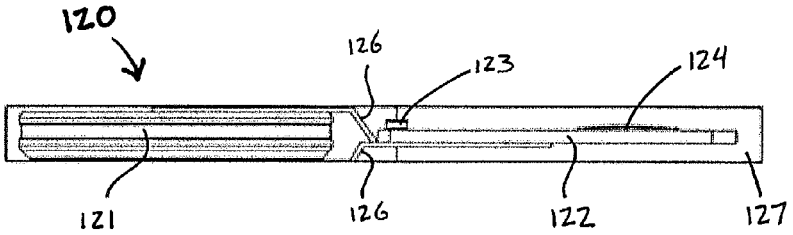
FIG. 5 shows a profile-view of the lighting unit from FIG. 4.
Figure 6:
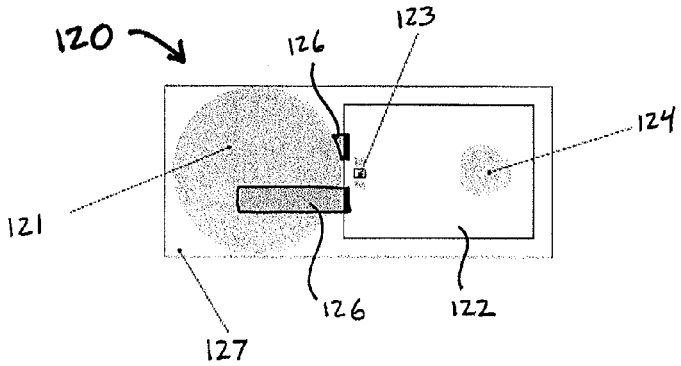
FIG. 6 shows a top plan-view of the lighting unit in FIG. 5.
Figure 7:
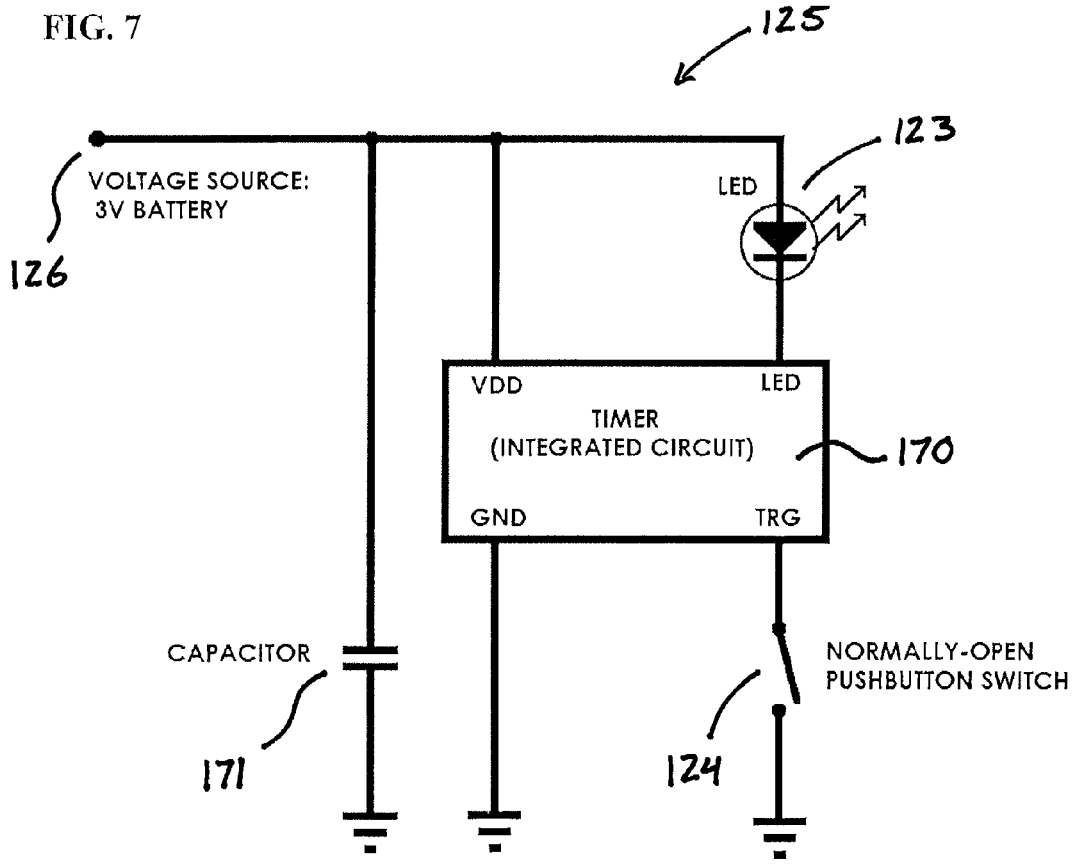
FIG. 7 shows a schematic of an exemplary circuit of the lighting unit in FIG. 5.

As shown by FIG. 4, as well as the schematic views of FIGS. 5-6, the lighting unit 120 includes a power source 121 and a printed circuit board (PCB) 122. The PCB 122 includes a light source 123, a switch 124, an electrical circuit 125, and terminals 126. The circuit 125 electrically connects each of the power source 121 (via the terminals 126), the switch 124, and the light source 123. One example of a suitable circuit 125 for the light device 100 is illustrated in FIG. 7. The lighting unit 120 is made waterproof by containment within a hermetic enclosure 127. In some examples, the entire lighting unit 120 is sealed inside the hermetic enclosure 127, whereas in other examples one or more elements of the lighting unit 120 may be project through the hermetic enclosure 127. For example, a portion of the switch 124 and/or a portion of the light source 123 may project through the hermetic enclosure 127, provided the projecting portion is itself water-tight and there is formed a water tight seal at the location where the projecting portion projects through the hermetic enclosure 127. The example in FIG. 4 shows one scenario where a watertight silicon pressing pad 124*a* of the switch 124 projects through the hermetic enclosure 127, while an electrically-connected end 124*b* of the switch 124 is contained within the hermetic enclosure 127. In another example a watertight bulb-end of the light source 123 may project through the hermetic enclosure 127, while an electrically-connected end of the light source 123 is contained within the hermetic enclosure 127. As shown in FIG. 4, the hole 141 in the scattering layer 140 is aligned on a common vertical axis $Y_1$ with the light source 123.

Figure 8:
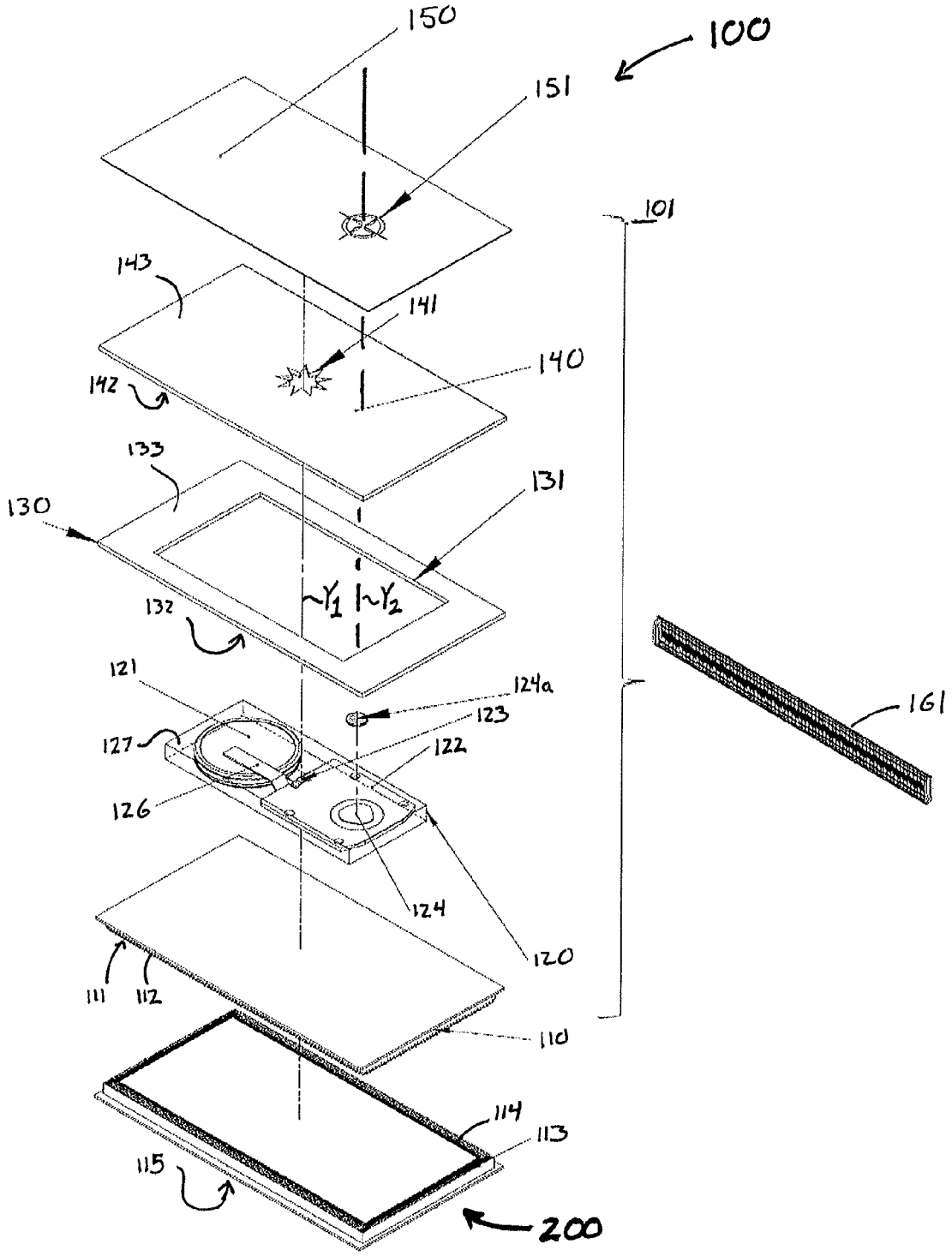
FIG. 8 shows an assembly-view of the light device in FIG. 1.

FIG. 8 shows an assembly-view of the light device 100, again showing the multilayered stack 101 as including each of the base layer 110, the spacer layer 130, the scattering layer 140, and the prism layer 150. FIG. 8 also shows a mounting unit 200 having a fastening element 113 in the form of a collection of loops 114 for mating with the collection of hooks 112 on the base layer 110. As shown in FIG. 8, the recess 131 in the spacer layer 130 is dimensioned to closely approximate the outer dimensions of the lighting unit 120 so as to receive the lighting unit 120 in a manner that prevents it from any appreciable movement in lateral directions. In this way, the spacer layer 130 maintains alignment of the light source 123 on the common vertical axis $Y_1$ with the hole 141 in the scattering layer 140; and maintains alignment of the switch 124 (and pressing pad 124*a*) on a common vertical axis $Y_2$ with the actuation mark 151 on the prism layer 150. As illustrated schematically in FIG. 8, the multiple layers in the multilayered stack 101 are secured to one another by a securement mechanism in the form of the stitching 161.

Assembly of the Light Device

While assembly of the light device 100 may occur in a sequential order in accord with the following discussion, it is understood that assembly may also occur with the various steps occurring in one or more different sequences.

The base layer 110 is arranged as a lower layer in the multilayered stack 101 to support other layers of the multilayered stack 101 thereabove on one side, and to provide the fastening element 111 on another side. The base layer 110 may also be referred to as a supporting layer, or the bottommost layer of the multilayered stack 101. As a supporting layer, it is preferable the base layer 110 be formed of a material that is malleable and durable. Suitable materials for forming the base layer 110 may include, though are not limited to: fabric, rubber, flexible plastics, and the like.

The material chosen for the base layer 110 may depend on the desired type of fastening element 111 to be attached on the bottom side thereof, as well as the desired type of securing mechanism 160 for securing the multilayered stack 101. For example, when the securing mechanism 160 is stitching 161, the base layer 110 is preferably made of a material through which the stitching 161 may pass without complication. As another example, when the fastening element 111 is one-half of a hook-and-loop fastener (e.g., either the hook collection, or the loop collection), the sheet carrying the fastener element (e.g., a Velcro® sheet) may itself serve as the base layer 110.

The fastening element 111, for joining with the mating fastening element 113 on the mounting unit 200, is provided to a side of the base layer 110 opposite the side at which the other layers in the multilayered stack 101 are supported. In the example of FIG. 8, the fastening element 111 on the base layer 110 is a collection of hooks 112, and the fastening element 113 on the mounting unit 200 is a collection of loops 114—such that the base layer 110 and mounting unit 200 may be releasably fastened to one another by a hook-and-loop fastener. In practice, however, the collections of hooks and loops may be reversed, such that the base layer 110 has a collection of loops and the mounting unit 200 has a collection of hooks.

The fastening elements 111/113 are not limited to hook-and-loop type elements, and may take a variety of other forms. For example, suitable fastening elements 111/113 may also include, though are not limited to: magnetic fasteners (e.g., with either one magnet and one ferrous metal, or with two magnets), mating tongue-and-groove fasteners (e.g., a tongue element that laterally slides into and out of a groove element); male-female fasteners (e.g., snap-fasteners); rod-and-ring fasteners (e.g., one or more arrangements of a rod received through two or more rings, with two or more rings supported by both the base layer 110 and the mounting unit 200—such as that in a doorway hinge); and releasable adhesive coatings (e.g., with either an adhesive material on each of the base layer 110 and the mounting unit 200, or an adhesive material on only one of the two).

Regardless of the fastener type, it is preferable the fastening elements 111/113 enable a tool-free releasable fastening operation in that the fastening elements 111/113 may be joined and again released without damaging the light device 100 or the fastening elements 111/113. It is also preferable, regardless of the fastener type, the combined fastening elements 111/113 present a minimal profile, so as to minimize the profile of the combined arrangement of the light device 100 and the mounting unit 200. A minimal profile of the fastening elements 111/113 may be one where the profile of the combined fastening elements 111/113 is less than or equal to the profile of the multilayered stack 101 (as viewed in a base layer 110 to prism layer 150 elevation). In some examples, the profile of the combined fastening elements 111/113 may be equal to or less than 6 mm, and is more preferably equal to or less than 3 mm.

The spacer layer 130 is positioned above the base layer 110, on the side opposite the fastening element 111. The spacer layer 130 may also be referred to as a light diffusing and scattering layer, and as an intermediate layer in the multilayered stack 101. The spacer layer 130 includes a bottom surface 132 facing the base layer 110, a top surface 133 facing away from the base layer 110, and a recess 131 that opens at least in the top surface 133. While the example in FIG. 8 shows the recess 131 as a through-hole extending entirely from the bottom surface 132 to the top surface 133 of the spacer layer 130, in other examples the recess 131 may be a blind-hole such that the recess 131 opens only at the top surface 133 facing away from the base layer 110. In examples where the recess 131 is a through-hole, the lighting unit 120 received in the recess 131 will rest on the top surface of the base layer 110. On the other hand, when the recess 131 is a blind-hole, the lighting unit 120 will rest on a lower surface of the recess 131 (e.g., a surface at a lower elevation relative to the higher elevation of the top surface 133 of the spacer layer 130).

Regardless of the hole type, the recess 131 is dimensioned to closely approximate the outer dimensions of the lighting unit 120 so as to prevent the lighting unit 120 from any appreciable movement in lateral directions, and maintain alignment of elements in the lighting unit 120 with other components of the light device (e.g., alignment along axes $Y_1$ and $Y_2$).

The spacer layer 130 enhances the structural rigidity of the light device 100. In particular, by presenting a relatively elevated top surface 133 around the recess 131, the spacer layer 130 facilitates a more uniform thickness in the multilayered stack 101 and lessens any degree of bulging that might otherwise result from simply sandwiching the lighting unit 120 between two successive layers in the multilayered stack 101. The recess 131 in the spacer layer 130 may also serve as a built-in physical locator for placement of the lighting unit 120 by an automated system, thereby simplifying assembly of the light device 100 by foregoing the need of a separate alignment system for positioning the lighting unit 120 at the necessary location for alignment purposes (e.g., along axes $Y_1$ and $Y_2$).

The spacer layer 130 is preferably made of a light-transmitting silicone, or a like material, preferably measuring between 0.5 mm and 2.0 mm in thickness, such that any light emitted from the light source 123 and reflected back upon the spacer layer 130 may be scattered and diffused through the silicone material thereof. In this way, by constructing the spacer layer 130 of a light-transmitting material such as silicone, the spacer layer 130 may serve a further purpose of retransmitting some quantity of reflected light to create an ambient lighting effect in the spacer layer 130 that enhances the overall lighting effect of the light device 100. Furthermore, by using a material such as silicone, the spacer layer 130 may present favorable resiliency and heat transfer properties that may serve the yet further purposes of a shock and bending force absorbing layer, and a heat dissipation layer—both of which may assist in preventing damage to the lighting unit 120 and the light device 100 as a whole.

In some examples, the lighting unit 120 may be a separate component positioned within the layers of the multilayered stack 101, whereas in other examples the lighting unit 120 may be of such a construction that it is itself a layer within the multilayered stack 101. In the example shown in FIG. 8, the lighting unit 120 is positioned within the recess 131 of the spacer layer 130. When the recess 131 is a through-hole, the lighting unit 120 will rest on the next layer below the spacer layer (e.g., the base layer 110); and when the recess 131 is a blind-hole, the lighting unit 120 will rest on a lower surface in the recess 131 at an elevation below the top surface 133 of the spacer layer 130. The lighting unit 120 includes the power source 121 and PCB 122; with the PCB 122 including the light source 123, switch 124, circuit 125, and terminals 126.

In the example shown in the figures, the light source 123 is a light-emitting diode (LED). Though the example of FIG. 8 shows only a single light source 123, the lighting unit 120 may include multiple light sources 123 (e.g., as in three or more), with the separate light sources 123 operating in unison or in alternate. When employing multiple light sources, the separate light sources 123 may be of different types, colors, sizes, intensities, etc.

In the example in the figures, the switch 124 is a press-type switch that is manipulated by application of a pressing force through the layers above the lighting unit 120 (e.g., by application of a pressing force to the prism layer 150, and transmission of that pressing force through the scattering layer 140 to the switch 124). However, other suitable switch-types may include, though are not limited to: optical sensors, temperature sensors, and other like switches.

The switch 124, at least as a pressing-type, may optionally include a pressing pad **124*a* to compensate for a vertical spacing differential between the switch 124 and the next layer thereabove (e.g., the scattering layer 140) so as to facilitate transfer of a pressing force to the switch 124. In some examples, the pressing pad 124*a* may have a thickness overcompensating for a vertical spacing differential between the switch and the next layer thereabove, thereby creating a bulge in the multilayered stack 101 that may serve as a tactile indicator informing a user of the switch 124 location. If included, the pressing pad 124*a* is preferably made from a material presenting a pleasant tactile sensation, such as silicone or a like material, preferably measuring between 4 mm and 12 mm in diameter, and between 0.5 mm and 1 mm in thickness. Other suitable materials for forming the pressing pad 124*a*** may include, though are not limited to: cork, polyvinyl chloride (PVC), rubber, metals, and the like.

In the example of FIG. 8, the power source 121 is a thin-profile battery (e.g., a button, coin, or disk type battery). However, other suitable power sources 121 may instead be used. The particular type of power source 121 chosen may vary depending on the nature of the lighting unit 120, and its power requirements. In examples using a single LED as the light source 123, the power source may be a disk-type battery outputting 50 mA to 250 mA, depending on the desired lighting effect.

The particular configuration of the circuit 125 on the PCB 122 may vary depending on, for example, the nature of the power source 121, the light source 123, the intended lighting effect of the light device 100, etc. FIG. 7 illustrates one suitable configuration for the circuit 125 that may be used with the exemplary light device 100 shown in FIG. 8 having a single LED-type light source 123 and a 210 mA disk-type battery as the power source 121.

The exemplary configuration for the circuit 125 includes a timer module 170 and a capacitor 171, and enables operation of the light source 123 between an OFF mode and at least three separate ON modes—the separate ON modes including, at least: a constant lighting operation; a low-speed strobing operation; and a high-speed strobing operation.

In the example in the figures, the lighting unit 120 is enclosed in a hermetic enclosure 127 in the form of a pouch. Such a pouch may be formed from two heat-sealable sheets by placing the lighting unit 120 between the two sheets and then heat-sealing the sheets at any free edges to fully enclose the lighting unit 120 within the pouch as a watertight and dustproof, hermetic enclosure 127. Such a pouch may also be made of two sheets of different character. For example, such a pouch may include an: opaque sheet laid-out as a lower surface of the pouch, with the lighting unit placed on the lower opaque sheet; and a translucent sheet laid-over the lighting unit 120 to minimize any interference with transmission of light emitted from the light source 123.

Other suitable forms for the hermetic enclosure 127 may include, though are not limited to: a rubber film, a cling film, an elastically shrinkable film, a heat-shrinkable film, a resin coating, and the like. In some examples, the hermetic enclosure 127 may simply be a single sheet of material or merely spot-applications of a sealing material, provided all electrical connections are hermetically sealed by the chosen enclosure type. Suitable materials for forming the hermetic enclosure 127 may include, though are not limited to: heat-sealable plastics; chemical, UV, or thermal setting resins; and materials chosen from vinyl, silicon rubber, natural rubber, thermo plastic rubber, plastic elastomer, plastic urethane, polypropylene, liquid adhesives, and the like.

Regardless of the enclosure type or the material chosen, the hermetic enclosure 127 preferably displays a favorable combination of a hermetic seal and light-transmission such that the electrical connections of the lighting unit 120 are protected from water and dust damage while at the same time minimizing any interference with transmission of light emitted from the light source 123. It is appreciated, however, that certain enclosure types may allow construction of the hermetic enclosure 127 from a hermetic sealing material that lacks any appreciable light-transmission character by instead permitting a portion of the light source 123 to project beyond the hermetic enclosure 127 without compromising the hermetic seal thereof. For example, a bulb-end of an LED type light source 123 may project through a hardened coating of an opaque resin or through an aligned aperture in a heat-shrunken sheet. In another example, an opaque sealing material may be applied by spot-application to cover only the electrical connections on the lighting unit 120 while leaving a light-emitting surface of the light source 123 uncovered.

The scattering layer 140 is positioned above the spacer layer 130, to overlie both the spacer layer 130 and the lighting unit 120. The scattering layer 140 may also be referred to as a light diffusing and scattering layer, and as an intermediate layer in the multilayered stack 101. The scattering layer 140 is made of a material having such a light-transmitting character that light striking a bottom surface 142 facing the lighting unit 120 is scattered and diffused through the material, and retransmitted out an opposing top surface 143 thereof (e.g., as in a top surface 143 facing away from the lighting unit 120). In this way, by constructing the scattering layer 140 of a light-transmitting material such as silicone, or other like materials, preferably measuring between 0.5 mm and 2.5 mm in thickness, the scattering layer 140 serves to transmit some quantity of light emitted from the light source 123 in a manner creating an ambient lighting effect in the scattering layer 140 that enhances the overall lighting effect of the light device 100.

As in the example in FIG. 8, the scattering layer 140 may include a hole 141 aligned along the vertical axis $Y_1$ with the light source 123. By providing the hole 141 in alignment with the light source 123, a quantity of light emitted from the light source 123 travels beyond the scattering layer 140 without any interference from the light scattering material thereof. As shown schematically in FIG. 9, with inclusion of the hole 141, the scattering layer 140 serves a further purpose of establishing a gradient light effect—whereby a relatively greater-intensity light A is output through the hole 141, while a relatively lesser-intensity light B is output via diffusion through the body of the scattering layer 140 and an intermediate-intensity light C is output at a region peripheral to the center region.

Though the example in FIG. 8 shows the hole 141 having a star shape, the hole 141 may be of any chosen shape—including, though not limited to: a circle, an oval, a square, a triangle, a diamond, and a star. The inventors have found, however, that the particular shape chosen for the hole 141 may influence the degree of light scattering and diffusion, at least at a region around the hole 141. While not being bound by theory, it is believed different hole-shapes that yield different surface area in the vertical wall(s) of the hole will result in different intensities of light at the perimeter of the hole 141—with shapes that yield a greater surface area in the vertical wall(s) of the hole 141 expected to yield greater diffusion of light, and a greater intensity in the light at the perimeter of the hole 141. In this way, selection of the shape for the hole 141 may influence the gradient light effect achieved by the scattering layer 140—with some shapes yielding an intermediate-intensity light C around the hole perimeter that is closer to the relatively greater-intensity light A output through the hole 141, and with some shapes yielding an intensity of the light around the hole perimeter that is closer to the relatively lesser-intensity light B output via diffusion through the further peripheral regions of the scattering layer 140.

Furthermore, by using a material such as silicone, the scattering layer 140 may present favorable resiliency and heat transfer properties that may allow the scattering layer 140 to serve the yet further purposes of a shock and bending force absorbing layer, and a heat dissipation layer—both of which may assist in preventing damage to the lighting unit 120 and the light device 100 as a whole.

The prism layer 150 is positioned above the scattering layer 140, and overlies the hole 141 formed therein. The prism layer 150 may also be referred to as a top, protective, and/or outermost layer of the multilayered stack 101 and/or the light device 100 as a whole. The prism layer 150 is made of a material having a one-way light-transmitting character and a one-way light-reflecting character, such that light striking the side corresponding with the one-way light-transmitting character is transmitted through the layer whereas light striking the side corresponding with the one-way light-reflecting character is reflected off the layer.

Optionally, the prism layer 150 may include an actuation mark 151 to serve as a visual indicator informing a user of the switch 124 location.

The prism layer 150 is oriented in the multilayered stack 101 such that the side corresponding with the one-way light-transmitting character faces in the direction of the lighting unit 120 and the side corresponding with the one-way light-reflecting character faces in a direction away from the lighting unit 120. With this arrangement, light originating from within the multilayered stack 101 (e.g., light originally emitted from the light source 123) is transmitted through the prism layer 150 without any significant disturbance, whereas light originating from outside the multilayered stack 101 (e.g., from outside the light device 100 as a whole) is reflected off the prism layer 150 and prevented from entering the multilayered stack 101.

A suitable material for constructing the prism layer 150 is a PVC microprism reflective film material having such a character that it is highly translucent in the light-transmitting direction, such that light travelling in the light-transmitting direction is not significantly disturbed by the one-way light transmitting character; while also being highly reflective in the light-reflecting direction, such that light travelling in the light-reflecting direction is substantially prevented from entering (or being absorbed in) the multilayered stack 101. With the use of a material such as the PVC microprism reflective film, preferably measuring between 0.15 mm and 2.0 mm in thickness, more preferably approximately 0.3 mm in thickness, and the foregoing orientation (transmission side in; reflective side out), the prism layer 150 yields and advantageous result in that when the light source 123 is in an OFF mode, the highly reflective character of the prism layer 150 enables continued use of the light device 100 as a reflective safety indicator. In this way, the light device 100 may continue to have a useful life beyond that of its power source 121. On the other hand, when the light source 123 is in an ON mode, the gradient light effect created by the scattering layer 140 is maintained through the prism layer 150 without any significant disturbance. In addition, light reflected by the prism layer 150 may compliment the gradient light effect emitted during an ON mode of the light source 123—in some instances presenting a shimmering effect within the gradient light effect. As a further benefit, the prismatic nature of the prism layer 150 presents an attractive appearance to the light device 100 while also obscuring the internal components thereof.

Other suitable materials for constructing the outermost layer of the multilayered stack 101 and/or light device 100 include, though are not limited to: fabric, rubber, silicone, plastic, kodura fabric, and the like. It being understood, of course, that selection of certain materials for the outermost layer may result in the loss of one of the one-way light characteristics that are provided by the PVC microprism reflective film.

The individual layers of the multilayered stack 101 are secured to one another by one or more securing mechanisms such that, in an assembled state, the multilayered stack 101 is an integral collection of the multiple layers (e.g., the base layer 110, the spacer layer 130, the scattering layer 140, and the prism layer 150), with the lighting unit 120 contained within that integral collection of the layers (either as a separate component therein, or as a layer itself). The individual securing mechanisms may include: mechanisms that secure individual pairs of layers to one another; mechanisms that secure all of the individual layers to one another; retention securing mechanisms; and releasing securing mechanisms.

An example of a securing mechanism that secures individual pairs of layers to one another is an adhesive coating. For example, a single adhesive coating may be applied to the surface of only one of the two layers in a pair of successive layers—or two separate adhesive coatings may be applied, with one coating for a surface on each of the two layers in a pair of successive layers. Adhesive coatings may be applied between each of the layers in the multilayered stack 101 (e.g., between the base layer 110 and the spacer layer 130; between the spacer layer 130 and the scattering layer 140; and between the scattering layer 140 and the prism layer 150), or between only select layers therein (e.g., between the base layer 110 and the spacer layer 130; between the higher elevated surface of the spacer layer 130 and the scattering layer 140; and/or between the scattering layer 140 and the prism layer 150). An adhesive coating may be applied over the entirety of a particular surface, or it may be applied along only a select portion of the particular surface (e.g., along only a perimeter area of the surface). Other suitable securing mechanisms for securing pairs of successive layers to one another may include, though are not limited to: heat seals, press fit layers, and the like. Use of a securing mechanism that secures individual pairs of layers to one another may facilitate assembly of the light device 100 by enabling placement of subsequent layers in the multilayered stack 101 while reducing the likelihood of a misalignment in a prior-placed layer when applying a subsequent layer.

An example of a securing mechanism that secures all of the individual layers in the multilayered stack 101 to one another is the stitching 161. The stitching 161 may secure the layers of the multilayered stack 101 by passing through each individual layer. In other examples, the stitching 161 may pass through only the outermost layers of the multilayered stack 101 (e.g., the prism layer 150 and the base layer 110), while the inner layers (e.g., the spacer layer 130 and the scattering layer 140) are held in place between the stitched-together outermost layers (e.g., by a slight compressive force from the outer most layers; and/or by a barrier created from the particular arrangement of the stitching 161). Other suitable securing mechanisms for securing all of the individual layers in the multilayered stack 101 to one another may include, though are not limited to: a lamination coating (e.g., full lamination of the multilayered stack 101, partial lamination at only lateral edges of multilayered stack 101, etc.); one or more spring-loaded clasps; tape binding; press methods (including heat press); and the like.

Retention securing mechanisms are ones wherein components in the multilayered stack 101 cannot be removed without damaging the light device 100 or the securement mechanism. Examples of retention securing mechanisms include, though are not limited to: a full lamination coating of the multilayered stack 101; stitching 161 through each of the layers; stitching 161 through only the outermost layers, though about a sufficient amount of the periphery or at a sufficient number of locations about the periphery to prevent removal of an inner layer; tape binding; heat press; and the like. Use of a retention securing mechanism for securing all layers in the multilayered stack 101 to one another may help prevent a user from accessing, and possibly damaging, inner components of the light device (e.g., the lighting unit 120).

Releasable securing mechanisms are ones that permit removal of one or more components of the multilayered stack 101 without damaging the light device 100 or the securing mechanism. Examples of releasable securing mechanisms include: spring-loaded clasps; specialized stitching patterns; zippers; hook-and-loop fasteners; and the like. One example of a specialized stitching pattern (as a releasable securing mechanism) may be one wherein stitching passes through only the outermost layers of the multilayered stack 101, and about only a portion of the periphery of the multilayered stack 101 (e.g., such as along three of four edges, with the fourth edge left entirely unstitched). Such a stitching arrangement may be made sufficiently tight to create a slight compressive force from the outermost layers that resists unintended movements of the inner layers—though which permits a user to relieve the compressive force of the outermost layers, such as by applying a slight squeezing force to the lateral sides of the multilayered stack 101, to enable withdrawal of an unstitched inner layer from the multilayered stack 101. Such a specialized stitching pattern (e.g., along three of four sides) may be accompanied by an aesthetic stitching along the unsecured portion (e.g., along the fourth side) that passes through only one of the layers in the multilayered stack 101 (e.g., through only the outermost layer or only the base layer), without interfering with the releasable nature of the specialized stitching pattern. The inclusion of such an aesthetic stitching together with the specialized securement stitching pattern may be used to create a visual appearance that all sides of the light device are secured by stitching, while in truth the side with the aesthetic stitching provides an opening that permits removal of one or more inner layers or components of the light device 100.

Use of a releasable securing mechanism for securing all layers in the multilayered stack 101 to one another may permit a user to freely replace individual components in the light device 100 (e.g., substituting different scattering or prism layers; replacing lighting unit 120).

The mounting unit 200 is a separate component from the light device 100, and is not secured to the multilayered stack 101 by the securing mechanism (e.g., the stitching 161 in the example of FIG. 8). The mounting unit 200 serves as a separate supporting unit for receiving the light device 100 and mounting the same to another article or object.

The mounting unit includes a fastening element 113 for mating with the fastening element 111 on the base layer 110. In the example in FIG. 8, the fastening elements 111/113 are shown as hook-and-loop type fasteners, with the mounting unit 200 having a collection of loops 114. In practice, however, the collections of hooks and loops may be reversed, such that the base layer 110 has a collection of loops and the mounting unit 200 has a collection of hooks.

The mounting unit 200 preferably has an additional fastening element 115 at the side opposite the side carrying the fastening element 113 for joining the mounting unit 200 to another article or object. The fastening element 115 may be any of the discussed fastening elements, though is not limited thereto. With the fastening element 115, the mounting unit 200 may be joined to articles and objects such as, though not limited to: clothing and garments; containers; structural surfaces; etc. such that the light device 100 may be releasably fastened to the same article or object as the mounting unit 200 by joining the mating fastening elements 111/113. Optionally, the fastening element 115 on the mounting unit 200 may be a permanent fastener, as in one that cannot be unfastened without damaging the light device 100 or the fastening mechanism. Suitable permanent fastening elements for the mounting unit 200 include, though are not limited to: a binding adhesive; stitching; and the like.

The material chosen for the mounting unit 200 may depend on the desired type of fastening elements 113/115. For example, when the fastening element 113 is one-half of a hook-and-loop fastener (e.g., either the hook collection, or the loop collection), the sheet carrying the fastener element (e.g., a Velcro® sheet) may itself serve as the mounting unit 200—in which instance an adhesive coating may serve as the fastening element 115.

Working Example

In a working example of the light device 100 shown in FIG. 8, the multilayered stack 101 was constructed with the measurements 70 L×38 W×6 H (mm). Velcro® pads were used for both the base layer 110 and the mounting unit 200, with the mounting unit 200 having the measurements 70 L×38 W×1.5 H (mm).

The spacer layer 130 and scattering layer 140 were both constructed from light-transmitting silicone each measuring 70 L×38 W×1 H (mm), such that the combined height of light diffusing and scattering material measured 2.0 mm; with the spacer layer 130 having a through-hole type recess 131 measuring 50 L×28 W×1 H (mm). The lighting unit 120 included a 210 mA disk-type battery, a single LED a press-type switch 124 with a circular silicone pressing pad **124*a* measuring 0.4 D×0.5 H (mm), and the exemplary circuit 125 of FIG. 7. The lighting unit 120 was enclosed in a vinyl pouch, having one translucent sheet on the side of the light source 123 and an opaque sheet on the bottom side thereof. The prism layer 150** was made of PVC microprism reflective film measuring 70 L×38 W×0.15 H (mm).

In assembling the multilayered stack 101, adhesive coatings were applied to: the side of the base layer 110 supporting the other layers of the multilayered stack 101; the underside of the pressing pad **124*a* facing the press-type switch 124; both sides of the spacer layer 130; both sides of the scattering layer 140; and the side of the prism layer 150 facing the scattering layer 140. As a further securing mechanism, stitching 161 was applied continuously about all four edges of the multilayered stack 101** and passing through each layer therein.

As shown in FIG. 8, the hole 141 in the scattering layer 140 of the working example was a nine-point star having a minor diameter of 5 mm and a major diameter of 10 mm. In tests comparing the working example against similarly constructed examples with differently shaped holes, the nine-point hole 141 was deemed to yield a more aesthetically appealing combination of direct and diffused light than that achieved by other star-shaped holes with different dimensions (3, 5 and 7 mm minor diameters, and 2x-major diameters) and circular shaped holes with similar dimensions (3, 5 and 7 mm diameters).

Figure 9:
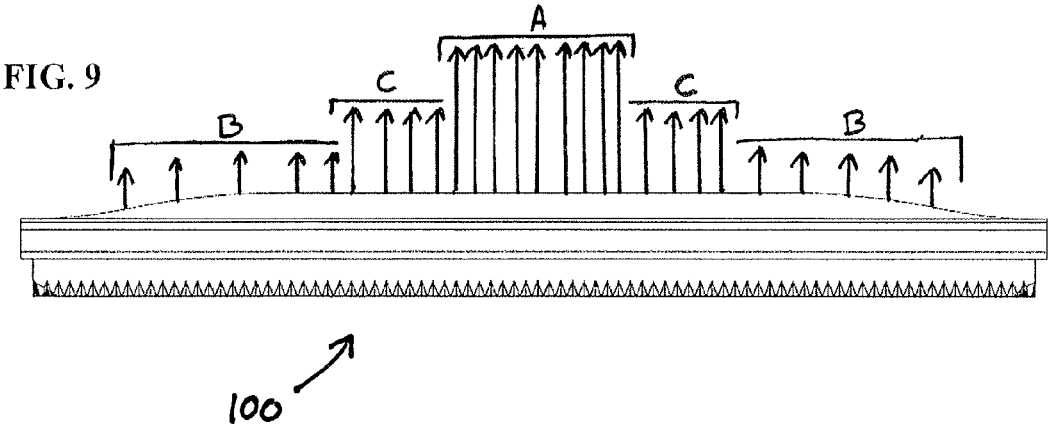
FIG. 9 shows a schematic of light intensities output by the light device in FIG. 1.

The working example of the light device 100 was observed to yield a unique lighting effect, as illustrated by the schematic in FIG. 9. In particular, there was observed: a first, relatively greater-intensity of light A emitted at a center region (corresponding with the aligned light source 123 and hole 141); a second, noticeably lesser-intensity of light B emitted at peripheral regions; and a third intermediate-intensity of light C emitted at an intermediate region between the center and peripheral regions. Upon directing a moving beam of light over the working example, there was also observed a shimmering effect, due to the reflective nature of the prism layer 150.

Other Examples

Figure 10:
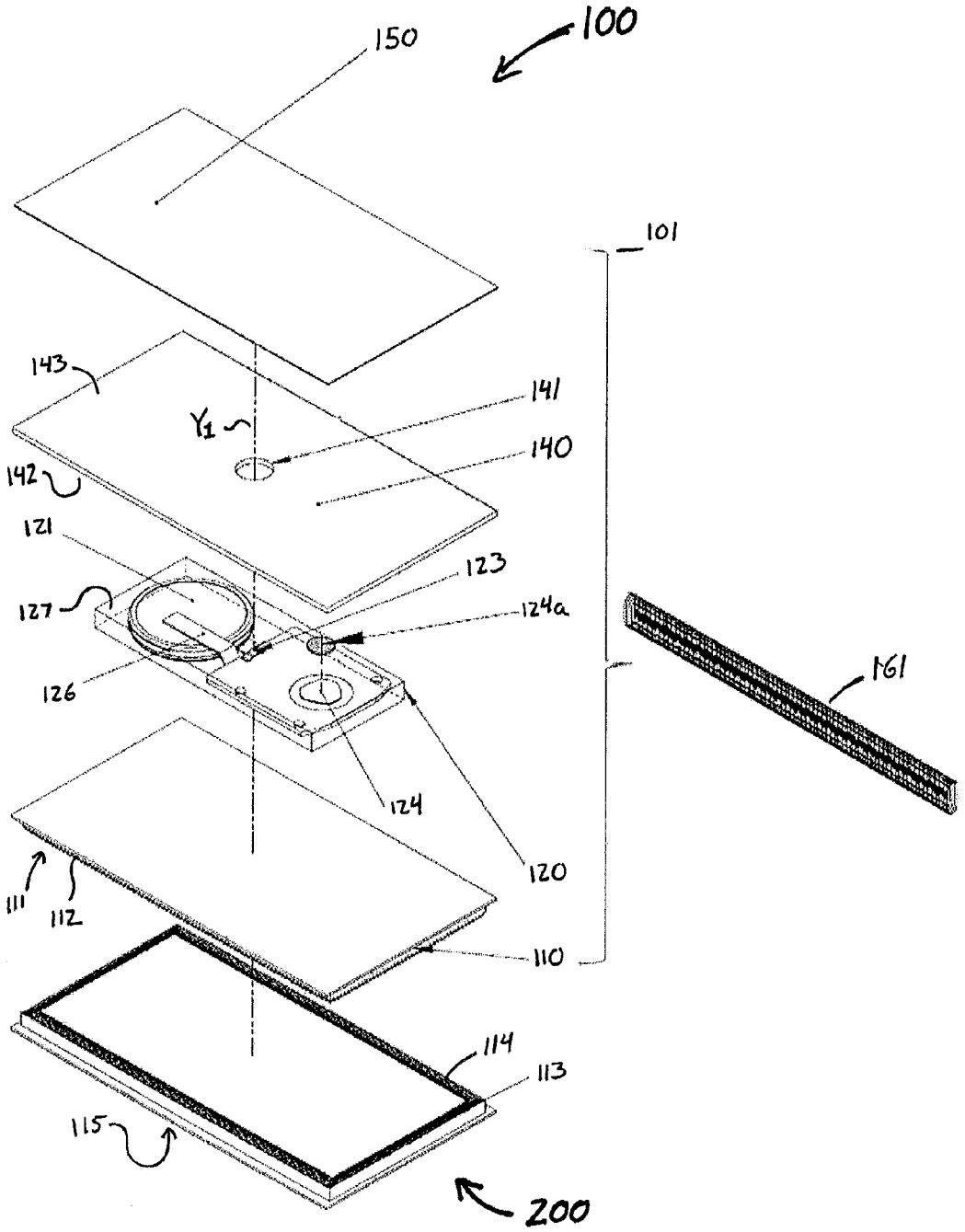
FIG. 10 shows an alternate assembly-view of the light device in FIG. 1.

FIG. 10 shows one example of an alternative construction for the light device 100. In FIG. 10, components corresponding to those in FIG. 8 are denoted by same reference symbols and the explanation thereof is omitted. Among the differences in the alternative design of FIG. 10 are: omission of an independent spacer layer 130; adoption of a circular shaped hole 141 (as opposed to a star shaped hole 141); and omission of an actuation mark 151 on the prism layer 150.

As discussed above, the shape of the hole 141 may be changed as desired, with the understanding that different shapes may yield different overall lighting effects from the light device 100. In some examples, the hole 141 may be omitted altogether—resulting in emission of lesser-intensity light over the entirety of the light device 100.

Figure 11A:
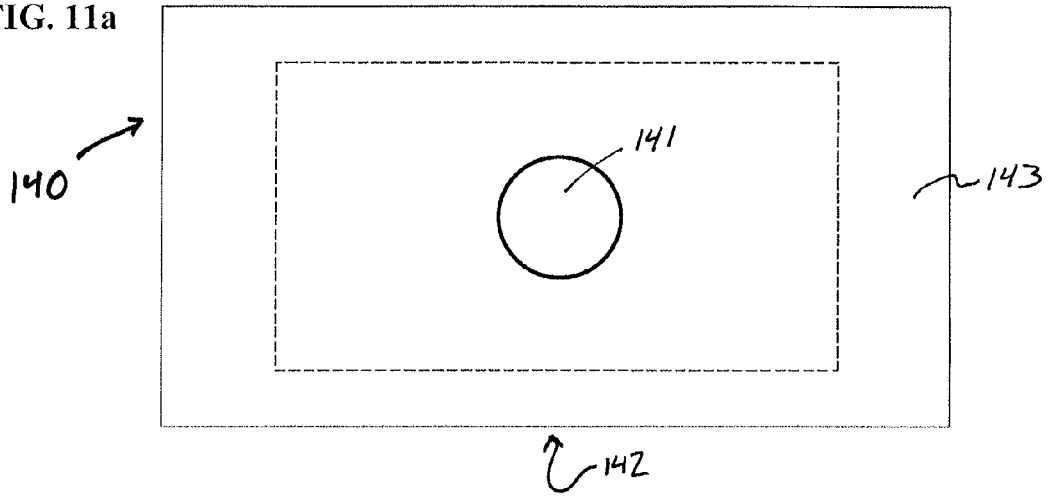
FIGS. 11*a*-11*c* show: (a) a top plan-view of a scattering layer in the light device in FIG. 10; (b) a profile view of the scattering layer in FIG. 11*a*; and (c) a bottom plan-view of the scattering layer in FIG. 11*a*.
Figure 11B:
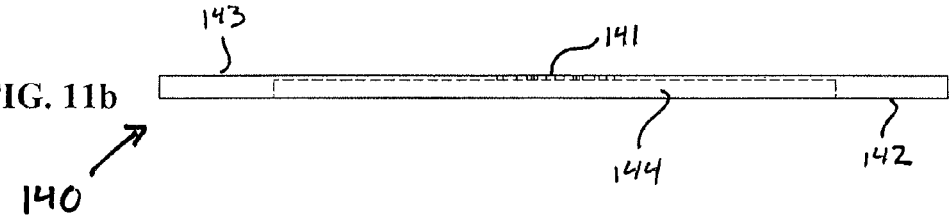
Figure 11C:
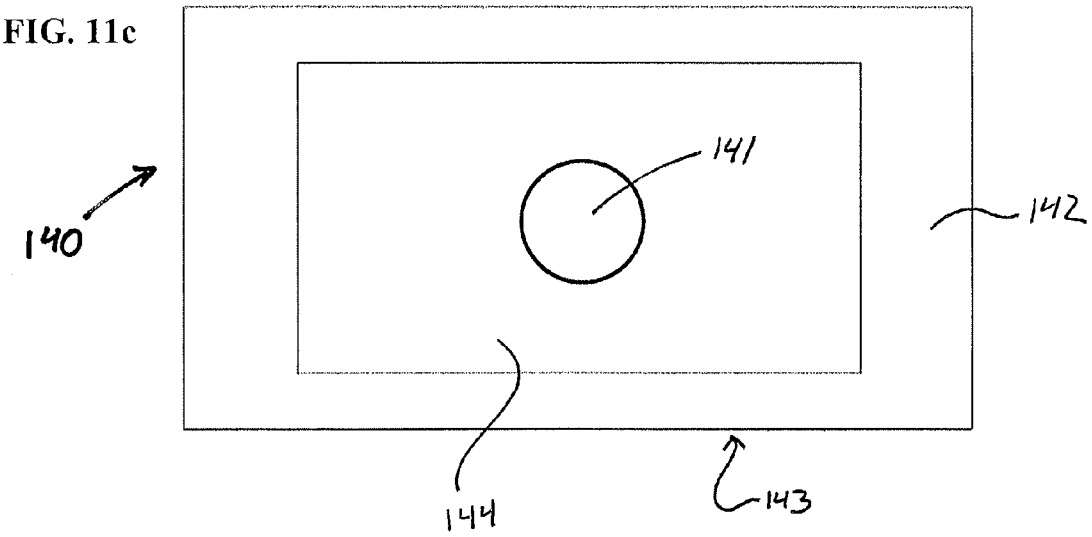

Alternative designs omitting the independent spacer layer 130 may be achieved in at least four ways. In a first scenario, the independent spacer layer 130 may simply be omitted from the multilayered stack 101, such that the lighting unit 120 is merely sandwiched between the base layer 110 and the scattering layer 140. Construction of the light device 100 under this first scenario may result in a bulge in the multilayered stack 101. In a second scenario, the independent spacer layer 130 may be omitted in favor of adopting an integrated spacer configuration in the bottom surface of the scattering layer 140. Such a configuration of the scattering layer 140 may also be referred to as a spacer-scattering layer. In particular, as shown in FIGS. 11*a*-11*c*, the scattering layer 140 may be formed with an integrated spacer configuration by forming a blind-hole type recess 144 in a bottom surface 142 of the scattering layer 140 facing the base layer 110. With such a recess 144, when the scattering layer 140 is placed over the lighting unit 120, the lighting unit 120 will extend into the recess 144 preferably with the bottom surface 142 of the scattering layer 140 coming to rest on the same lower surface that the lighting unit 120 rests on (e.g., the base layer 110). In a third scenario, the independent spacer layer 130 may be omitted in favor of adopting an integrated spacer configuration in the top surface of the base layer 110. Such a configuration of the base layer 110 may also be referred to as a spacer-base layer. In particular, the base layer 110 may be formed with an integrated spacer configuration by forming a blind-hole type recess in a top surface of the base layer 110 facing the scattering layer 140. With such a configuration, the lighting unit 120 will be received in the recess in the base layer 110 and the scattering layer 140 will overlie both the base layer 110 and the lighting unit 120. In a fourth scenario, both the base layer 110 and the scattering layer 140 may be formed with separate blind-hole type recesses, such that the lighting unit 120 rests in the recess of the base layer 110, and projects into the recess of the scattering layer 140.

Though the foregoing description discusses the present invention with reference to particular examples, those skilled in the art will understand the present invention, as defined by the appended claims and their equivalents, is not limited to only the foregoing examples. As such, the scope of the invention may encompass additional embodiments embracing various changes and modifications relative to the examples disclosed herein without departing from the scope of the invention as defined in the appended claims—including the adoption of one or more elements from a first embodiment disclosed herein for inclusion in a second embodiment disclosed herein.

For example, those skilled in the art will understand that one or more additional layers may be added to the multilayered stack, provided they do not interfere with the basic operation of the light device. Also, those skilled in the art will appreciate the mounting unit need not be an independent layer or sheet for joining to a separate article or object; and that the mounting unit may in fact be an integrated portion of another article or object (e.g., as in a section of clothing, an animal collar, etc.).

While the scope of the invention may encompass embodiments consisting of (or consisting essentially of) only the elements disclosed herein, those skilled in the art will appreciate that further elements may also be added, and that some disclosed elements may be omitted. Likewise, while the disclosed methods may be performed by executing all of the disclosed steps in the order disclosed, without any intermediate steps therebetween, those skilled in the art will appreciate the methods may also be performed: with further steps interposed between the disclosed steps; with the disclosed steps performed in an order other than the exact order disclosed; with one or more disclosed steps performed simultaneously; and with one or more disclosed steps omitted.

To the extent necessary to understand or complete the disclosure of the present invention, all publications, patents, and patent applications mentioned herein are expressly incorporated by reference herein to the same extent as though each were individually so incorporated. In addition, ranges expressed in the disclosure are considered to include the endpoints of each range, all values in between the end points, and all intermediate ranges subsumed by the end points.

The present invention is not limited to the specific examples illustrated herein, and is instead characterized by the appended claims.

What is claimed is:

1. A light device comprising:

a multilayered stack comprising a supporting base layer, a spacer layer above the base layer, a scattering layer above the spacer layer, and a prism layer above the scattering layer; and a lighting unit comprising a power source, a light source, a switch, and a circuit electrically connecting the power source, light source, and switch, wherein the base layer of the multilayered stack comprises a fastening element on a bottom side for joining with a mating fastening element, the lighting unit is contained within the multilayered stack, below the scattering layer, the spacer layer comprises a recess dimensioned to receive the lighting unit in a manner to limit lateral movement of the lighting unit within the multilayered stack, the scattering layer is made of a light-transmitting material that diffuses light emitted from the light source, the scattering layer comprising a hole that extends entirely through the scattering layer, and the prism layer is made of a prismatic material having a one-way light-transmission character that allows light emitted from the light source to pass outside the multilayered stack, and having a one-way light-reflective character that reflects light originating from outside the multilayered stack.

2. The light device of claim 1, wherein the layers of the multilayered stack are secured to one another such that the multilayered stack is an integral collection of the multiple layers.

3. The light device of claim 1, wherein the layers of the multilayered stack are releasably secured to one another such that an inner layer of the multilayered stack, or a component within the multilayered stack, may be releasably removed from the multilayered stack.

4. The light device of claim 1, wherein the switch is a press-type switch, and the layers of the multilayered stack are constructed in a manner that a user may manipulate the switch by application of a pressing force with their finger at the outermost layer.

5. The light device of claim 1, wherein the recess of the spacer layer extends entirely through the spacer layer.

6. A method for making the light device of claim 1, comprising:

positioning the prism layer in the multilayered stack.

7. A light device comprising:

a body comprising a bottom surface and a top surface, with a lighting unit and an intermediate layer contained between the bottom and top surfaces, wherein the top surface is an at least one-way light transmitting surface, the lighting unit comprises a light source arranged to emit light towards the top surface, the intermediate layer is made of a light-diffusing material and is positioned between the lighting unit and the top surface, the intermediate layer having a hole that extends entirely through the intermediate layer and a recess that extends partially through the intermediate layer, and the recess in the intermediate layer is dimensioned for receiving the lighting unit in a manner to align the light source along a common vertical axis with the hole in the intermediate layer.

8. The light device of claim 7, wherein the lighting unit further comprises a power source and a switch electrically connecting the power source with the light source for switching the light source between ON and OFF modes, and when the light source is in an ON mode, the arrangement of the intermediate layer, with the hole axially aligned with the light source, and the at least one-way light transmitting top surface result in a gradient light effect with a relatively greater intensity light emitted at a center region of the light device, and a relatively lesser intensity light emitted at peripheral regions of the light device.

9. The light device of claim 8, wherein the gradient light effect further comprises an intermediate intensity light emitted at an intermediate region about the center region of the light device.

10. The light device of claim 8, wherein the top surface is both an at least one-way light transmitting surface and a one-way light reflecting surface, and when the light source is in an OFF mode, the light device is useable as a reflective safety indicator.

11. A method for making the light device of claim 7, comprising:

aligning the hole in the intermediate layer with the light source.

12. A light device comprising:

a casing comprising a bottom layer, a spacer layer, an intermediate layer, a top layer, and a lighting unit received within a space defined between the bottom and top layers, wherein the top layer is an at least one-way light transmitting layer, the intermediate layer is made of a light-diffusing material that diffuses light emitted from the lighting unit, the intermediate layer comprising a hole that extends entirely through the intermediate layer, the spacer layer comprises a recess dimensioned to receive the lighting unit in a manner to limit lateral movement of the lighting unit within the casing, the bottom layer comprises one-half of a releasable fastener, and the lighting unit is rendered waterproof by a hermetic enclosure.

13. The light device of claim 12, wherein stitching extends along a periphery of the light device.

14. The light device of claim 13, wherein the stitching secures the bottom and top layers to one another in manner to retain the lighting unit within the casing in an unremovable state.

15. The light device of claim 12, wherein the top layer, is both a one-way light transmitting layer and a one-way light reflecting layer.

16. The light device of claim 12, wherein the light device is a portable light device configured for mating with a separate mounting unit having one-half of a releasable fastener that mates with the one-half releasable fastener on the bottom layer.

17. A method for making the light device of claim 12, comprising:

positioning the lighting unit between the bottom and top layers.

18. A method for making the light device of claim 12, comprising:

securing the bottom and top layers with stitching.

19. The light device of claim 12, wherein the intermediate layer is secured to at least the top layer by stitching.

20. The light device of claim 12, wherein the casing is adapted for removal and reinsertion of the intermediate layer.

21. The light device of claim 12, wherein the casing is adapted for removal and reinsertion of the lighting unit.

* * * * *